US006666705B1

(12) United States Patent
Lauruhn et al.

(10) Patent No.: US 6,666,705 B1
(45) Date of Patent: Dec. 23, 2003

(54) METHOD AND APPARATUS FOR AGP UNIVERSAL CONNECTOR

(75) Inventors: Jeff Lauruhn, Folsom, CA (US); Daryl James Nelson, Beaverton, OR (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 09/302,584

(22) Filed: Apr. 30, 1999

(51) Int. Cl.[7] ..... H01R 13/64

(52) U.S. Cl. ..... 439/377; 439/59; 439/680; 439/951

(58) Field of Search ..... 439/377, 680, 439/681, 59, 951, 55, 218, 233

(56) References Cited

U.S. PATENT DOCUMENTS

| | | | | |
|---|---|---|---|---|
| 2,983,896 A | | 5/1961 | Gilbert | |
| 3,193,791 A | | 7/1965 | Bock et al. | |
| 3,491,267 A | * | 1/1970 | Goshorn | 174/252 |
| 3,675,186 A | | 7/1972 | Jayne et al. | |
| 3,818,280 A | | 6/1974 | Smith et al. | |
| 4,869,672 A | | 9/1989 | Andrews Jr. | |
| 5,769,668 A | | 6/1998 | Tondreault | |

OTHER PUBLICATIONS

Intel Corporation, Accelerated Graphics Port Interface Specification, Revision 2.0, May 4, 1998.

* cited by examiner

*Primary Examiner*—Truc Nguyen

(74) *Attorney, Agent, or Firm*—Blakely, Sokoloff, Taylor & Zafman LLP

(57) ABSTRACT

A first aspect of the invention is an electrical connector that includes a housing formed to include first and second opposing ends and an elongated slot between the ends. The slot receives a connective edge of a printed circuit card. Closely spaced contacts located in the slot engage conductive pads on the printed circuit card. A first alignment member is formed integrally at the first end of the housing, to engage a non-polarized keyway during insertion of the printed circuit card into the elongated slot, aligning the printed circuit card relative to the contacts. A second aspect of the invention is the keying of the printed circuit card along a connective edge. The connective edge includes two connective regions which define a polarized keyway between the two connective regions. A third, non-connective, region located at one end of the connective regions defines a non-polarized keyway between the connective regions and the non-connective region. The polarized keyway is the dimensional datum point for fabrication of the printed circuit card and the non-polarized keyway is located precisely with reference to the polarized keyway. A third aspect of the invention is that different types of the printed circuit card, differentiated by the location of the polarized keyway, and the electrical connector form a system in which the connector may receive any of the types of the printed circuit card.

6 Claims, 3 Drawing Sheets

METHOD AND APPARATUS FOR AGP UNIVERSAL CONNECTOR

BACKGROUND OF THE INVENTION

1. Field of the Invention

The present invention relates to an electrical connector that receives a printed circuit card and couples the printed circuit card electrically to a mother printed circuit board. More particularly, the present invention relates to an electrical connector having an alignment member for aligning the printed circuit card relative to the connector during insertion of the printed circuit card into the connector to align conductive pads on the printed circuit card with electrical contacts of the connector.

2. Background Information

It is well known to provide card-edge electrical connector sockets for electrically coupling a printed circuit card board to a main mother printed circuit board. As electrical components get smaller and smaller, spacing between contacts of the electrical connector and between the conductive pads on the printed circuit card is reduced. Tighter positional tolerances are required on the connector in order to ensure proper engagement between the contacts of the connector and the pads of the printed circuit card. It is known to replace some generally centralized pad positions in the printed circuit card with a slot or keyway that mates with an alignment post or key formed in the connector socket to provide polarization and alignment between the printed circuit card and the socket. The selected clearance gap between the keyway and the key, plus the manufacturing tolerances of both the keyway and the key, aligns the conductive pads of the printed circuit card with the contacts of the electrical connector closely enough to make a proper connection.

An exemplary add-in printed circuit card is the Accelerated Graphics Port (AGP) add-in card described in the *Accelerated Graphics Port Interface Specification. Revision* 2.0, Intel Corporation, May 4, 1998. (Available on the Worldwide Web at http://www.intel.com/pc-supp/platform/agfxport/index.htm) FIG. 1 is an exploded view showing a typical assembly of an AGP add-in card 20 to a mother board 10. The electrical connection between the printed circuit board and the mother board is provided by a connector 30. An AGP card has conductive pads along a portion of one edge for connection to the AGP bus through the connector. The connector has a pitch of 1.00 mm between centers of adjacent contacts allowing the overall length of the connector to be less than 75 mm. The fine pitch of the contacts requires that the use of a keyway to locate the pads relative to the connector contacts with great accuracy. The keyway 26 for the AGP add-in card is specified to have a width of 1.88+/−0.05 mm. The key formed on the socket connector is specified to have a width of 1.78+/−0.03 mm. Therefore, the clearance between the keyway formed in the add-in card and the key in the socket is 0.10 mm+/−0.08 mm due to manufacturing tolerances. The keyway is the datum point for location of the pads when the printed circuit card in manufactured. The key is the datum point for the location of the contacts when the connector is manufactured. The mating of the keyway to the key aligns these two manufacturing datum points to within 0.18 mm.

Two types of AGP cards have been defined, a 3.3 volt card and a 1.5 volt card. The 3.3 volt card uses 3.3 volt signaling and operates at a bus speed of either 66 MHz or 133 MHz. The 1.5 volt card uses primarily 1.5 volt signaling, although clock and reset are 3.3 volts, and operates at a bus speed of 266 MHz. To prevent connection of a 3.3 volt AGP card to a 1.5 volt AGP bus or connection of a 1.5 volt AGP card to a 3.3 volt AGP bus, the alignment keys for the two cards are in different locations. FIG. 2 shows the connecting edge of a 3.3 volt card 20 and FIG. 4 shows the connecting edge of a 1.5 volt card 60. The specifications for both cards allow the same connector to be used for both cards by making the 1.5 volt card connector edge a 180° rotation of the 3.3 volt card connector edge. In particular, the keyway 26 for the 3.3 volt card is located between pads 41 and 43 counting from the left of the component side; the 1.5 volt card keyway 66 is located between pads 41 and 43 counting from the right of the component side (pads 81 and 83 from the left).

The AGP architecture allows a motherboard to be constructed with a 3.3 volt AGP bus using a keyed connector so that only 3.3 volt AGP cards can be inserted into the connector. Likewise, a 1.5 volt AGP bus can be provided that accepts only 1.5 volt AGP cards using the same keyed connector installed with the opposite orientation. Thus, the keying provides polarization to prevent installation of printed circuit cards that are incompatible with the bus in addition to providing alignment of the manufacturing datum points. It is known to produce an AGP card that is compatible with both the 3.3 volt AGP bus and the 1.5 volt AGP bus where the card has two polarized keyways so that it may be inserted in either a 3.3 volt AGP connector or a 1.5 volt AGP connector.

An AGP bus can be designed that can electrically accommodate either a 3.3 volt only card or a 1.5 volt only card. However, the keying of the prior art prevents a single installed connector from accepting both types of cards. Accordingly, there is a need for a connector that can accept printed circuit cards with a variety of polarized keyings and still provide highly accurate positioning of the printed circuit card pads relative to the connector contacts.

SUMMARY OF THE INVENTION

A first aspect of the invention is an electrical connector that includes a housing formed to include first and second opposing ends and an elongated slot between the ends. The slot receives a connective edge of a printed circuit card. Closely spaced contacts located in the slot engage conductive pads on the printed circuit card. A first alignment member is formed integrally at the first end of the housing, to engage a non-polarized keyway during insertion of the printed circuit card into the elongated slot, aligning the printed circuit card relative to the contacts. A second aspect of the invention is the keying of the printed circuit card along a connective edge. The connective edge includes two connective regions which define a polarized keyway between the two connective regions. A third, non-connective, region located at one end of the connective regions defines a non-polarized keyway between the connective regions and the non-connective region. The polarized keyway is the dimensional datum point for fabrication of the printed circuit card and the non-polarized keyway is located precisely with reference to the polarized keyway. A third aspect of the invention is that different types of the printed circuit card, differentiated by the location of the polarized keyway, and the electrical connector form a system in which the connector may receive any of the types of the printed circuit card.

DETAILED DESCRIPTION OF THE INVENTION

Figure 1:
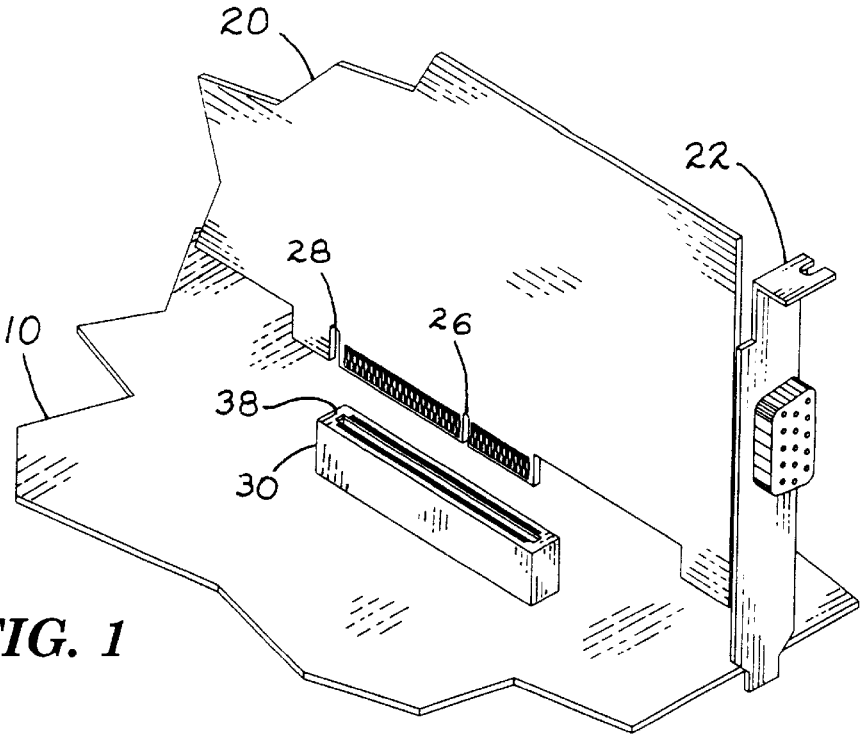
FIG. 1 is a pictorial view of a printed circuit card being inserted into a connector according to the present invention.

FIG. 1 illustrates an embodiment of the present invention which provides a card and a connector system for cards having closely spaced connector pads, such as connector pads with a nominal center spacing of 1 mm or less. The connective edges of the cards 20 are formed in a manner that provides a polarized keyway 26 and a non-polarized keyway 28. Both keyways serve the purpose of providing alignment to a mating connector 30 on a motherboard 10. Only one of the two keyways is engaged by any particular connector. The system permits a family of related cards to be produced where each card in the family places the polarized keyway in a different position. These cards can be inserted into conventional connectors with cooperative alignment keys, such that the alignment key properly aligns the connector and the card and prevents incompatible cards from being inserted into the connector.

The connector portion of the system is a universal connector 30 that provides a non-polarized key 38 that engages the non-polarized keyway 28 of the cards 20 embodying the present invention to properly align the connector and the card. The universal connector is able to receive all the related cards of the family. In this way, a family of cards, each requiring a different connection, can be produced for use in a corresponding family of conventional polarized connectors 20 that provide the specific electrical connection required by a specific card. The universal connector makes it possible to provide a single connector that can mechanically receive any of the cards in the family when a connection is provided that is electrically adaptive to provide the specific electrical connection required by a specific card. For example, a connector can be provided according to the present invention to receive either a 3.3 volt Accelerated Graphics Port (AGP) card 20 (FIG. 2) that has a keyway 26 between pad positions 42 and 43 or a 1.5 volt AGP card 60 (FIG. 4) that has a keyway 66 between pad positions 81 and 83.

Figure 2:
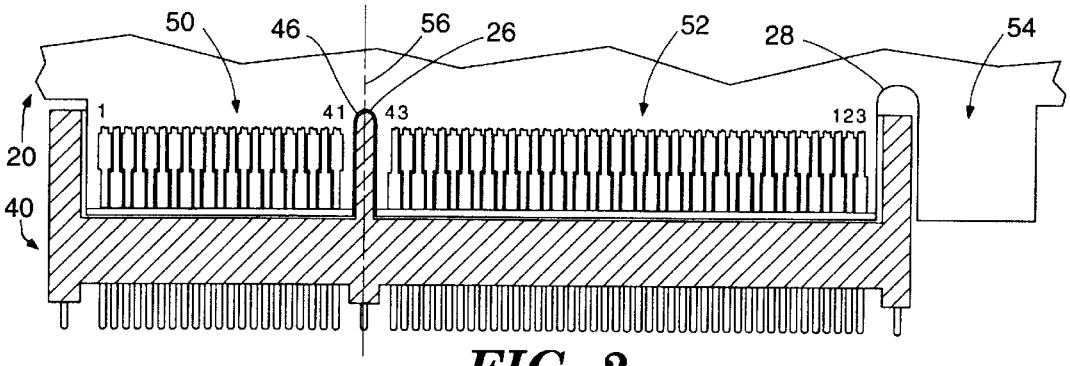
FIG. 2 is a printed circuit card that embodies the present invention inserted into a conventional connector.

FIG. 2 illustrates a printed circuit card 20 that embodies the present invention. The connective edge of the card includes two regions 50, 52 containing connective pads and a third region 54 without connective pads. The adjacent edges of the first two regions define a polarized keyway 26. The adjacent edges of the second and third regions define a non polarized keyway 28. The polarized keyway typically serves as the positional datum for fabrication of the printed circuit board as indicated by reference line 56.

FIG. 2 shows a first printed circuit board 20 of the present invention inserted in a conventional connector 40 having a polarized key 46 that engages the polarized keyway 26 of the printed circuit board. The non-polarized keyway 28 has a dimension that provides clearance around the end of the conventional connector 40 so that the non-polarized keyway does not engage the connector.

Figure 3:
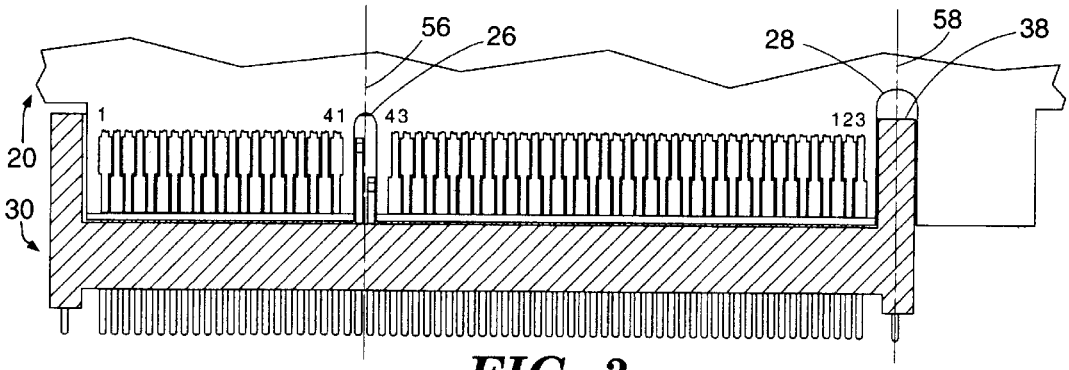
FIG. 3 is the printed circuit card of FIG. 2 inserted into a connector that embodies the present invention.

FIG. 3 shows the first printed circuit board 20 of the present invention inserted in a universal connector 30 of the present invention having a non-polarized key 38 that engages the non-polarized keyway 28 of the printed circuit board. The non-polarized key is formed by increasing the thickness of the end of the connector to form an aligning member that will properly align the connector and the printed circuit board. It should be observed that the printed circuit card aligns a conventional connector at the primary datum 56 while aligning a universal connector at a secondary datum 58. The relationship between the primary and secondary datum of the printed circuit card must be properly controlled to successfully implement the present invention.

Figure 4:
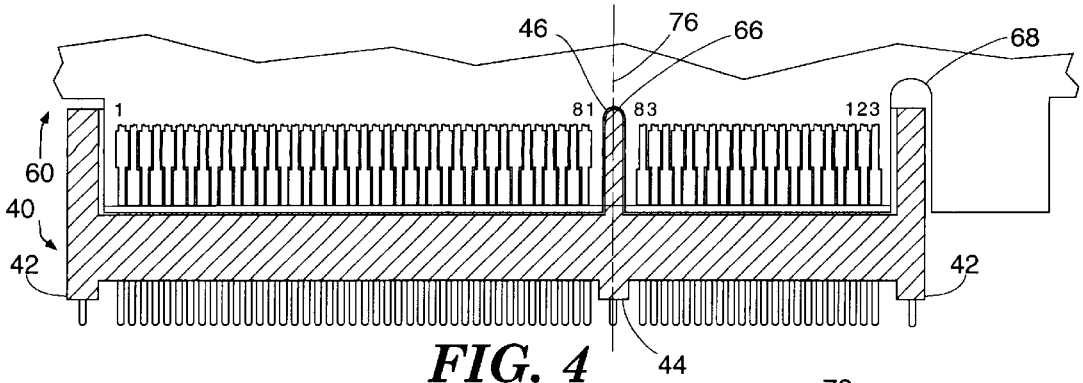
FIG. 4 is a second printed circuit card that embodies the present invention inserted into a conventional connector.
Figure 5:
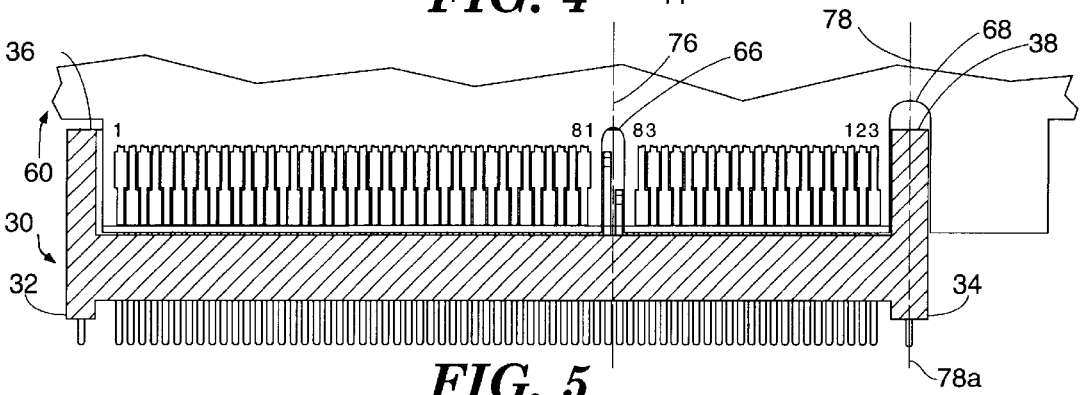
FIG. 5 is the printed circuit card of FIG. 4 inserted into a connector that embodies the present invention.

FIG. 4 shows a second printed circuit board 60 of the present invention inserted in a conventional connector 40 having a polarized key 46. FIG. 5 shows the second printed circuit board 60 inserted in the universal connector 30 of the present invention. The second printed circuit board 60 is another member of the family that includes the first printed circuit board 20. It will be observed that all members of a board family have connective edges that differ only in the position of the polarized keyway 26, 66. Pad positions are, of course, omitted from a board in the vicinity of the polarized connector. The electrical connection is designed in such a way that pads which are omitted for the polarized keyways are at positions with redundant signals.

It may be noted that in the example shown in FIGS. 2 and 4, which is illustrative of two AGP family boards, the polarization has been designed so that the same conventional connector 40 can be used for both applications by reversing the orientation of the connector. This does not create a universal connector however, because, as seen in FIG. 1, the mechanical orientation of the board 20 is fixed relative to the motherboard by the mechanical connection 22 that secures the board in position. The reversibility of the conventional connector is merely an inventory convenience that permits use of the same connector part to provide a specific polarized connector of either type.

It may be observed in FIG. 5 that the embodiment of the connector 30 shown provides an aligning member to serve as a non-polarized key 38 at only one end. The aligning member end is characterized by having a width that closely matches the non-polarized keyway 68. The close fit of the aligning member to the keyway causes the secondary datum 78 of the card to be substantially coincident with the datum of the connector 72.

The opposing end 36 is narrower than the aligning member end in this embodiment. It will be appreciated that this embodiment of the connector requires that the connector be installed with a specific orientation so that the aligning member end is correctly oriented with respect to the motherboard. The connector includes hold-down clips 32, 34 for holding the connector in position during assembly of the motherboard. In the embodiment shown, the hold down clip 34 at one end is larger than the hold down clip 32 at the opposite end. By providing closely matching holes in the motherboard to receive the hold down clips, the connector can be restricted to assembly in the proper orientation.

Figure 6:
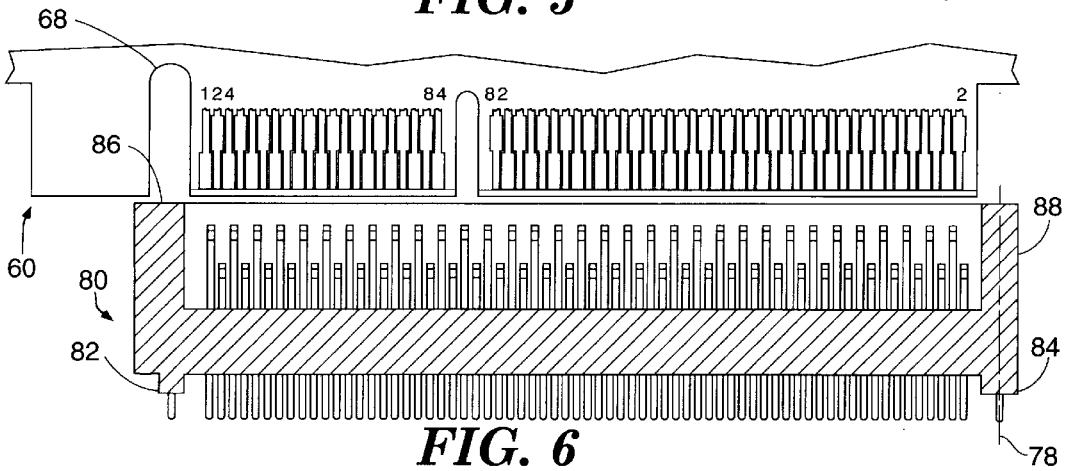
FIG. 6 is the printed circuit card of FIG. 4 with insertion being prevented by a connector that embodies the present invention.

FIG. 6 shows another embodiment of a connector 80 of the present invention. In this embodiment, the non-aligning end 86 is wider than the aligning member 88 to prevent insertion of the printed circuit board 60 with the incorrect orientation. This is useful in applications where the printed circuit board is not otherwise limited to a single orientation. This embodiment also shows the use of dissimilar hold down clips 82, 84 to orient the connector during assembly to the motherboard.

Figure 7:
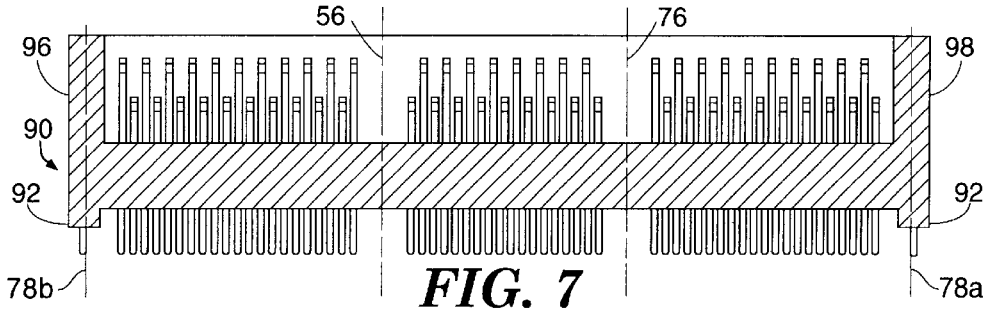
FIG. 7 is another connector that embodies the present invention.

FIG. 7 shows another embodiment of a connector 90 of the present invention. In this embodiment, one end 98 is the primary aligning member. However the opposite end 96 is also dimensioned and located so that it serves as a secondary aligning member. The primary aligning member is distinguished from the secondary aligning member only in that the primary aligning member serves as the positional datum for the fabrication of the connector. Line 72 represents the primary datum for the connector. Nominally, the connector is completely symmetrical with a 2-fold axis of symmetry. That is, the connector appears the same when rotated end for end by 180 degrees. It will be appreciated that when the secondary alignment member engages the non-polarized keyway, a secondary datum 74 is being used to align the connector to the card. This creates a stacking tolerance that will be described below.

Since the embodiment of the universal connector 80 shown in FIG. 7 is symmetrical, the hold-down clips 92 are substantially similar in size to permit assembly of the universal connector in either orientation. By making these hold-down clips substantially similar in size to the hold-down clips 42 of the conventional polarized connector 40 (FIG. 4), the universal connector can be assembled on a motherboard designed to hold a conventional connector. It may be noted in this regard, that the conventional connector must be assembled in a specific orientation. The conventional connector 40 includes a third hold down clip 44 which is offset between the first two hold down clips 42, generally in alignment with the polarized key. This embodiment of the universal connector 80 simply omits the third hold down clip because the it is not necessary to orient the symmetrical universal connector.

FIG. 7 illustrate another feature that is particularly important when interchangeable assembly with conventional connectors is desired. The contact pins are omitted in the positions 56, 76 of the polarized keyways for all cards that are intended to be received by the universal connector. These contacts must be omitted if the connector is to be assembled to a motherboard designed to receive a conventional connector because the conventional connector has a hold-down clip rather than contact pins in the vicinity of the polarized key. Omitting these contacts is also beneficial because the polarized keyways might interfere with contacts in those positions during insertion of the printed circuitcard. For this reason, it can also be beneficial to omit contacts from non-symmetrical embodiments of the universal connector similar to the embodiments previously described.

It may be seen in FIGS. 2 through 5, that the connector pads are staggered so that adjacent pads engage the connector at two alternating depths. Pad 1 engages the connector further from the edge than does adjacent pad 3. It should also be noted that the opposing pads are also staggered so that pad 2 (not shown), which is on the opposite side of the card directly behind pad 1, engages the connector closer to the edge than does opposing pad 1. The connector pad has a width of about 1.09+/−0.05 mm in the area were it engages the connector contact. The space between adjacent traces in the connector edge is about 0.25+/−0.05 mm.

The fine pitch of the connector pads requires that the keyway locate the pads relative to the connector contacts with great accuracy. The non-polarized keyway 28 for an AGP add-in card employing the present invention is specified to have a width of 3.40+/−0.05 mm. The aligning member of the universal connector is specified to have a width of 3.30+/−0.03 mm. Therefore, the clearance between the keyway formed in the add-in card and the key in the socket is 0.10 mm+/−0.08 mm due to manufacturing tolerances.

Figure 8:
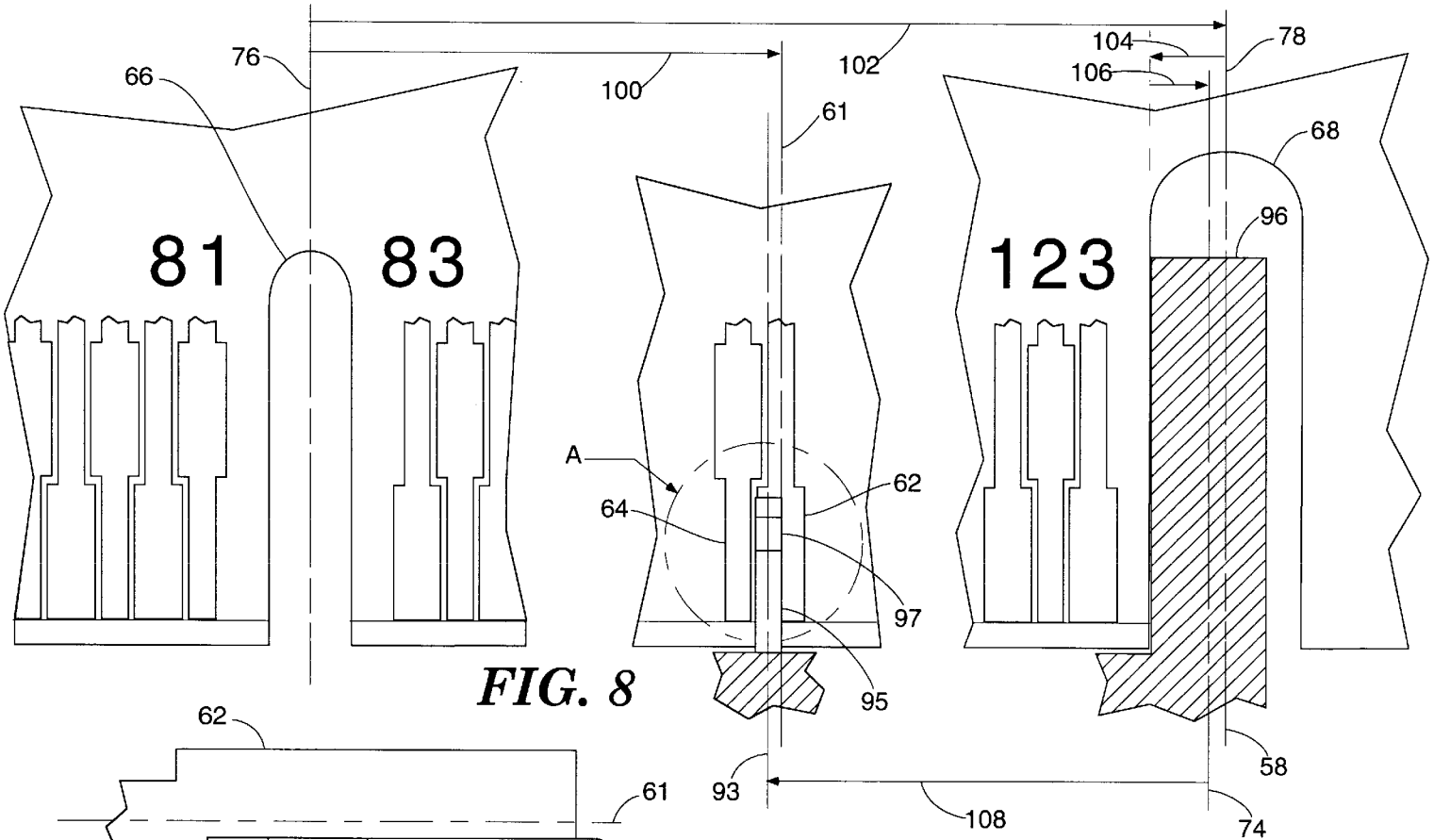
FIGS. 8 and 8A are details of the connector of FIG. 7 and the printed circuit card of FIG. 5 showing a positional relationship.

FIG. 8 illustrates how the positional relationship between a connector contact 95 and a pad 62 on the printed circuit card is established when the secondary keyway 68 is used to align the printed circuit card 60 (FIG. 5) to the secondary connector key 96 of a symmetrical universal connector 90 (FIG. 7). The misalignment of parts in FIG. 8 and detail FIG. 8A has been exaggerated so that the effect of the permissible tolerances can be seen more clearly. FIG. 8 will be explained with reference to the dimensions of an AGP add-in card and connector that embody the present invention.

If a secondary keyway 68 is used to align the printed circuit card to a universal connector using the secondary keying end 96 to align the connector and the card, several tolerances are stacked to arrive at the final connector contact 95 to pad 62 tolerance.

The printed circuit card 60 is fabricated using the primary keyway 66 as the positional datum 76 for all features of the board. The connector pads 62 have a positional tolerance of +/−0.05 mm relative to the primary keyway. This means that the centerline 61 of a pad may be offset by as much as 0.05 mm from the nominal position. The secondary keyway 68 also has a positional of tolerance of +/0.05 mm and the secondary datum 78 established by the secondary keyway is therefore less precise than the positional datum of the primary key. The centerline of a pad may therefore be offset by as much as 0.10 mm relative to the secondary keyway.

The universal connector 90 is fabricated using the primary keying end 98 (FIG. 7) as the positional datum 72 for all features of the connector. The secondary keying end 96 and the connector contacts 95 have a positional tolerance of +/0.05 mm. The secondary datum 74 established by the secondary key is therefore less precise than the positional datum of the primary key. Thus the connector contacts have a positional tolerance of +/0.10 mm relative to the secondary keying end.

The secondary keyway has a dimensional tolerance of +/−0.05 mm for the width of the keyway. The universal connector has a dimensional tolerance of +/0.03 mm for the width of the end section that engages the secondary keyway. There is a nominal clearance of 0.10 mm between the keyway and the keying end. In a worst case, where the secondary keying end is undersized, the secondary keyway is oversize, and the secondary keyway is engaged with all the clearance on one side, the datum 74 of the secondary keying end 96 may be offset from the datum 78 of the secondary keyway 68 by as much as 0.09 mm, one-half the maximum clearance between the keying end and the keyway.

In the worst case of the pad 62 being offset 0.10 mm toward the secondary keyway 68 (distance 100 is long and distance 102 is short), the contact 95 being offset 0.09 mm toward the pad from the secondary keyway (distance 104 is long and distance 106 is short), and the contact being offset 0.10 away from the secondary keying end (distance 108 is long), the centerline 93 of the contact may be offset by as much as 0.29 mm relative to the centerline of the pad 61.

Figure 8A:
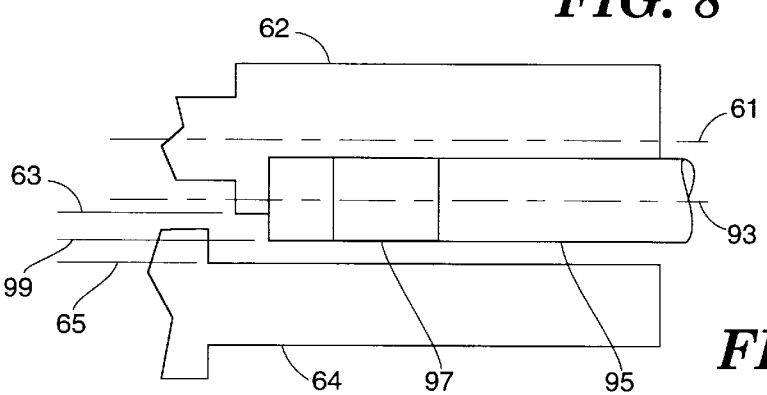

The effect of a misalignment between the contact 95 and the pad 62 is seen in FIG. 8A which is an enlargement of circled area A in FIG. 8. FIG. 8A shows the parts rotated 90° counter-clockwise from their orientation in FIG. 8.

The contact 95 will be considered as having a square cross-section although it actually is somewhat rounded because of the plating process that deposits the greatest thickness away from the edges of the contact. The contact is formed so that a small area 97 makes contacts with the pad 62.

The pad 62 has a width of 1.09+/−0.05 mm. In the worst case of an undersized pad, the edge 63 of the pad is 0.52 mm from the centerline 61 of the pad. Since the worst case contact to pad misalignment is 0.29 mm relative to the centerline of the pad, the centerline 93 of the contact will always be on the pad.

The contact 95 has a width of 0.74+0.10/−0.05 mm. In the worst case of an oversized contact, the edge 99 of the contact is 0.42 mm from the centerline of the contact. The contact may extend beyond the pad by as much as 0.13 mm. Adjacent pads are offset and connected by traces 64 that run between pads. The trace has a width of 0.41+/−0.05 mm. Adjacent traces have centerlines spaced at 1.00+/−0.05 mm. In the worst case, the edge 65 of the adjacent trace may be as close as 0.72 mm from the centerline 61 of the adjacent pad. Thus, even in the worst case, there will be 0.30 mm clearance between a contact and the adjacent trace.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

What is claimed is:

1. A system comprising:

a first printed circuit card and a second printed circuit card, each printed circuit card including a connective edge, a first connective region adjacent to the connective edge, said first connective region having a first end and an opposing second end, said first and second ends being perpendicular to the connective edge, a first plurality of conductive pads adjacent to the connective edge in the first connective region, a second connective region adjacent to the connective edge, said second connective region having a third end and an opposing fourth end, said third and fourth ends being perpendicular to the connective edge, said third end being adjacent to the second end, a second plurality of conductive pads adjacent to the connective edge in the second connective region, a non-connective region adjacent to the connective edge, said non-connective region having a fifth end and an opposing sixth end, said fifth and sixth ends being perpendicular to the connective edge, said fifth end being adjacent to the fourth end, a polarized keyway defined by the second end and the third end, and a non-polarized keyway defined by the fourth end and the fifth end, said non-polarized keyway at a predetermined location with reference to the polarized keyway;

wherein the first, fourth, and fifth ends of the first and second printed circuit cards are in substantially identical spatial relationships in relation to each other, the second and third ends of the first and second printed circuit cards are in substantially identical spatial relationships in relation to each other, and the second and fourth ends of the first and second printed circuit cards are in substantially different spatial relationships in relation to each other.

2. The printed circuit card of claim 1, wherein the polarized keyway of each printed circuit card is a positional datum for the printed circuit card and the non-polarized keyway is positioned with an accuracy of 0.05 of a millimeter relative to the polarized keyway.

3. The printed circuit card of claim 2, wherein the distance between the fourth end and the fifth end of each printed circuit card is fabricated with an accuracy of 0.05 of a millimeter.

4. The printed circuit card of claim 3, wherein the first and second pluralities of conductive pads of each printed circuit card are positioned with an accuracy of 0.05 of a millimeter relative to the polarized keyway.

5. The printed circuit card of claim 4, wherein each conductive pad is separated from any adjacent conductive trace by at least 0.2 of a millimeter.

6. The printed circuit card of claim 5, wherein each conductive pad has a width of at least 1.04 millimeters.

* * * * *

UNITED STATES PATENT AND TRADEMARK OFFICE

CERTIFICATE OF CORRECTION

PATENT NO. : 6,666,705 B1
DATED : December 23, 2003
INVENTOR(S) : Lauruhn et al.

It is certified that error appears in the above-identified patent and that said Letters Patent is hereby corrected as shown below:

Title page,
Item [54], delete "METHOD AND APPARATUS FOR AGP UNIVERSAL CONNECTOR", insert -- PRINTED CIRCUIT CARD CONNECTOR HAVING A POLARIZED AND A NON-POLARIZED KEYWAY --.

Column 3,
Line 45, after "connectors", delete "20".

Signed and Sealed this

Fourth Day of May, 2004

JON W. DUDAS
*Acting Director of the United States Patent and Trademark Office*